US009574769B2

(12) United States Patent
Ponzi et al.

(10) Patent No.: US 9,574,769 B2
(45) Date of Patent: Feb. 21, 2017

(54) METHOD, SYSTEM AND APPARATUS FOR FIRING CONTROL

(71) Applicant: Lummus Technology Inc., Bloomfield, NJ (US)

(72) Inventors: Peter R. Ponzi, Randolph, NJ (US); Francesco Bertola, Nutley, MA (US); Robert J. Gartside, Summit, NJ (US)

(73) Assignee: Lummus Technology Inc., Bloomfield, NJ (US)

( * ) Notice: Subject to any disclaimer, the term of this patent is extended or adjusted under 35 U.S.C. 154(b) by 920 days.

(21) Appl. No.: 13/849,935

(22) Filed: Mar. 25, 2013

(65) Prior Publication Data

US 2013/0224669 A1 Aug. 29, 2013

Related U.S. Application Data

(62) Division of application No. 11/881,099, filed on Jul. 25, 2007, now Pat. No. 8,408,896.

(51) Int. Cl.

| | |
|---|---|
| ***F23C 5/08*** | (2006.01) |
| ***F23D 14/10*** | (2006.01) |
| ***F23D 14/08*** | (2006.01) |
| ***F23D 14/60*** | (2006.01) |
| ***F23D 14/64*** | (2006.01) |

(Continued)

(52) U.S. Cl.

CPC ..... *F23D 14/10* (2013.01); *F23C 5/08* (2013.01); *F23D 14/08* (2013.01); *F23D 14/60* (2013.01); *F23D 14/64* (2013.01); *F23L 7/00* (2013.01); *F23N 1/002* (2013.01); *F23N 1/022* (2013.01); *F23L 2900/07002* (2013.01); *F23N 2021/10* (2013.01); *F23N 2035/06* (2013.01); *F23N 2037/08* (2013.01)

(58) Field of Classification Search

USPC ..... 431/12, 285, 72, 2; 126/116 R

See application file for complete search history.

(56) References Cited

U.S. PATENT DOCUMENTS

| | | | | |
|---|---|---|---|---|
| 3,877,876 A | | 4/1975 | Cheng | |
| 3,969,069 A | * | 7/1976 | Knaak | F27D 7/00 236/1 E |

(Continued)

OTHER PUBLICATIONS

Office Action issued in corresponding European Application No. 08780301.1 dated Nov. 13, 2015 (4 pages).

(Continued)

*Primary Examiner* — Avinash Savani

(74) *Attorney, Agent, or Firm* — Osha Liang LLP

(57) ABSTRACT

Disclosed herein is a method of controlling the air to fuel ratio in a burner containing a venturi assembly. The venturi includes an air inlet, a primary fuel inlet with a converging section, a throat portion downstream from the converging section, a diverging section downstream from the throat portion, an outlet, and a secondary gas inlet disposed downstream from the converging section and upstream from the outlet. The method comprises introducing fuel into the fuel inlet, receiving air through the air inlet by inspiration, and feeding a gas through the secondary gas inlet, the flow rate and content of the gas fed through the secondary gas inlet being selected to result in a desired air to fuel ratio through the outlet. A method of firing a heater, a burner, a furnace and firing control systems also are disclosed.

10 Claims, 10 Drawing Sheets

(51) Int. Cl.

| | |
|---|---|
| ***F23L 7/00*** | (2006.01) |
| ***F23N 1/00*** | (2006.01) |
| ***F23N 1/02*** | (2006.01) |

(56) References Cited

U.S. PATENT DOCUMENTS

| | | | | |
|---|---|---|---|---|
| 4,091,783 | A * | 5/1978 | Laprade | F02D 41/0027 123/587 |
| 4,473,490 | A * | 9/1984 | Stewart | C01B 3/38 252/373 |
| 4,640,674 | A | 2/1987 | Kitchen | |
| 4,659,306 | A * | 4/1987 | Altemark | F23N 1/022 236/15 E |
| 4,749,122 | A * | 6/1988 | Shriver | F23N 1/022 122/448.1 |
| 5,180,302 | A | 1/1993 | Schwartz et al. | |
| 5,368,476 | A * | 11/1994 | Sugahara | F23D 14/58 431/285 |
| 6,370,863 | B2 * | 4/2002 | Muller | F23C 7/00 60/776 |
| 6,616,442 | B2 | 9/2003 | Venizelos et al. | |
| 8,408,896 | B2 | 4/2013 | Ponzi et al. | |
| 2001/0018171 | A1 * | 8/2001 | Al-Halbouni | F23C 7/00 431/8 |
| 2006/0249596 | A1 | 11/2006 | Chou et al. | |
| 2007/0296976 | A1 * | 12/2007 | Jannasch | C21C 5/38 356/451 |

OTHER PUBLICATIONS

Official Action issued in corresponding Philipines Application No. 1-2010-500202 dated May 8, 2014 (1 page).

Office Action issued in corresponding Canadian Application No. 2,694,290 dated Mar. 20, 2013 (2 pages).

Search Report issued in corresponding Taiwanese Application No. 097127179 dated Jan. 13, 2014 (6 pages).

Examination Report issued in corresponding Malaysian Application No. PI 20082724 dated Jan. 15, 2014 (3 pages).

Office Action issued in corresponding Chinese Application No. 200880108443.5 dated Apr. 1, 2013 (11 pages).

Official Action issued in corresponding Philipines Application No. 1-2010-500202 dated Apr. 25, 2013 (1 page).

Office Action issued in European Application No. 08780301.1; dated Aug. 2, 2016 (6 pages).

* cited by examiner

METHOD, SYSTEM AND APPARATUS FOR FIRING CONTROL

CROSS-REFERENCE TO RELATED APPLICATIONS

This application is a divisional application and claims benefit under 35 U.S.C. §120 to U.S. patent application Ser. No. 11/881,099, filed Jul. 25, 2007, issued as U.S. Pat. No. 8,408,896, on Apr. 2, 2013, which is incorporated by reference in it's entirety.

BACKGROUND

The embodiments disclosed herein relate to gas burners and to the firing of such burners.

Burners are known that use fuel to inspirate air through a venturi tube and introduce a premixed air-fuel mixture that then travels into a furnace. The venturi assembly, specifically the throat area of the venturi tube, is designed such that for the desired fuel flow, the amount of air that is inspirated is slightly above the stoichiometric amount of air required for complete combustion. The air required for complete combustion is defined as the air flow that provides the oxygen necessary for combusting the fuel to $CO_2$ and $H_2O$. Typically, there is a deflector, cap or grill assembly downstream of the venturi assembly in order to alter the flow direction of the mixture to control the direction of the flame, and/or to create sufficient velocity exiting the burner to prevent flashback. Flashback is a phenomenon in which the speed of the combustion reaction (burning) is faster than the speed of the effluent from the burner, and the combustion can thus travel backward into the burner itself and result in damage to the burner assembly by the high temperatures of combustion.

U.S. Pat. No. 6,616,442 discloses a burner that is designed to be located in the floor of a furnace for firing vertically up a radiant wall. There is a primary nozzle that inspirates air into a venturi assembly and a grill located downstream of the venturi assembly is designed to increase the velocity of the fuel-air mixture entering the furnace in order to prevent flashback. The venturi assembly is designed such that only a portion of the fuel to be fired in the total burner is used to inspirate all of the required air. Thus, the venturi assembly has an effluent of premixed air-fuel that is air-rich (lean). The balance of the fuel is added in secondary ports located on the edge of the burner.

Burners incorporating lean premix (LPM) technology are known. LPM technology has been used in low $NO_x$ burners and uses a venturi assembly to inspirate air. This arrangement is designed to form a lean (air rich) fuel mixture that enters the furnace. Secondary fuel ports that are included in the burner are located outside the venturi assembly and add additional fuel to reach generally slightly above stoichiometric combustion conditions. It is important to note that the location of the fuel injection points for the burner determines the quality of the flame and the $NO_x$ production of that flame. If reduced airflow is desired, the fuel to the primary port is reduced. This will inspirate less air. Alternately a damper upstream of the venturi is used to create a pressure drop that would inhibit the flow of air to the venturi. This reduced airflow creates a different air-fuel mixture in the venturi assembly effluent. In the extreme, no fuel is provided at that point and air is drawn through the venturi based only upon the natural draft of the furnace itself. The flame created with an extremely fuel lean mixture (a low amount of fuel premixed with the air) and substantial fuel fired in secondary ports will be unstable.

U.S. Pat. No. 6,607,376 discloses a burner for firing on the wall of a furnace. The burner consists of a venturi assembly in which the air flow is created by the flow of the total fuel through a primary port at the venturi throat. The venturi assembly is designed such that the quantity of air inspirated by the fuel will result in an air-fuel mixture slightly above stoichiometric. The fuel flow at the primary location and the damper assembly are the means for changing air flow. The premixed air-fuel mixture leaving the venturi is then directed along the wall by a cap with orifices to promote radial flow from the wall burner.

U.S. Pat. No. 6,796,790 also discloses a burner for firing on the wall of the furnace. In the described embodiment, primary fuel is used to inspirate air through a venturi assembly. The venturi assembly is designed such that the fuel will provide excess air with respect to the primary fuel. The air rich (fuel lean) effluent from the venturi assembly is then directed through a cap with orifices to direct the flame along the walls of the furnace. In this case, however, additional fuel is injected on the outside of the venturi assembly and cap directly into the furnace. This fuel mixes with the air rich mixture as the mixture exits the cap assembly with the resulting air-fuel mixture in the vicinity of the burner being slightly above stoichiometric.

Stoichiometric combustion is defined as the quantity of air (or oxygen) that will completely combust the fuel to carbon dioxide and water. This corresponds to the maximum flame temperature for the fuel. Typically, combustion is operated at a slight excess of air, typically 10-15%. This provides control over the combustion but minimizes the energy loss created by higher amounts of excess air leaving the furnace at temperatures above ambient. If combustion is operated below stoichiometric conditions (fuel rich) unburned fuel remains in the flue gas representing energy losses as well as pollution. If combustion is operated well above stoichiometric, then there is a significant energy penalty due to the hot excess air leaving the system.

Thermal $NO_x$ formation is influenced by flame temperature. The maximum flame temperature is at the point of stoichiometric combustion. This will form maximum thermal $NO_x$. Technology is known such that operation under air rich (above stoichiometric) or fuel rich (sub-stoichiometric) conditions will reduce flame temperatures and hence $NO_x$. Certain low $NO_x$ burners are designed for lean conditions from the venturi to lower the primary flame temperature and reduce $NO_x$ but then inject (stage) secondary fuel into the primary flame above the burner to give slightly above stoichiometric conditions in total. The net result of staging is a lower combustion temperature since there is also mixing of lower temperature flue gases in the furnace with the combusting gases of the flame.

U.S. Patent Publication No. 2005/0106518 A1 includes a burner layout and firing pattern arrangement in which hearth burners of an ethylene furnace are operated with air in amounts above stoichiometric levels. The excess air is created not by increasing the air flow but by removing fuel from the secondary ports of hearth burners and then injecting that fuel through the wall of the heater just above the hearth burner. This pulls the flame to the wall by creating a low pressure zone behind the principal flame from the hearth burner. The flow of fuel through the primary port still controls the total amount of air inspirated and the air flow for that burner remains the same.

In the design of venturi assemblies for either hearth or wall burners, a very important characteristic is the volumetric heating value of the fuel and the required air to fuel ratio to achieve stoichiometric combustion. Typical gaseous fuel for ethylene plants or refinery heaters is a mixture consisting primarily of methane and hydrogen. This fuel requires approximately 20 pounds of air per pound of fuel to supply the oxygen required for stoichiometric combustion. However in some other combustion cases, other fuels may represent more desirable options. One such fuel is a synthesis gas consisting of a mixture of carbon monoxide (CO) and hydrogen. This mixture has a lower volumetric heat release and requires considerably less air for stoichiometric combustion, on the order of 3 pounds of air per pound of fuel. Volumetric heat release is defined as the heat released from complete combustion per volume of fuel. For example, if a fuel includes CO, the carbon is already partially oxidized (burned) and thus there is less energy released when the CO is burned to $CO_2$ than if that fuel contained only hydrocarbon species.

If a burner with a typical venturi assembly is designed for a given fuel, for example a methane-hydrogen mixture, it is very difficult to operate that burner with a fuel of significantly lower volumetric heat release, for example synthesis gas. For the same mass flow of primary fuel into the venturi throat as a methane-hydrogen fuel, a synthesis gas would inspirate the equivalent amount of air. This would represent considerably more air than required for combustion since the methane-hydrogen mix requires an air to fuel ratio of 20 compared to the synthesis gas required air-fuel of 3 for stoichiometric conditions. Thus, furnaces with burners designed to operate with one gaseous fuel can not be operated efficiently with significantly different fuel requiring different air flows. If a burner is designed for synthesis gas fuel, it can not readily be adapted to combust other fuels in the event the synthesis gas for which it was designed becomes unavailable.

SUMMARY

It would be useful to provide a burner and firing system that can be conveniently adapted to operate using different fuel types. It would be advantageous also to provide a burner that would allow for small changes in the air to fuel ratio for a given fuel. Furthermore, it would be useful to provide a control system that would allow for both the switching of fuels as well as control of the air to fuel ratio when firing a single fuel.

One embodiment is a method of controlling the air to fuel ratio in a burner comprising a venturi assembly having an upstream air inlet, a converging portion with a primary injection fuel inlet, a throat portion downstream from the converging portion, a diverging portion downstream from the throat portion, and an outlet. A secondary gas inlet is disposed downstream from the converging portion and upstream from the outlet. The method comprises introducing fuel into the primary injection fuel inlet, receiving air through the air inlet by inspiration, and feeding a gas through the secondary gas inlet. The flow rate and content of the gas fed through the secondary gas inlet are selected to result in a desired air to fuel ratio through the outlet.

The fuel usually has a heating value in the range of about 100 BTU/stdcuft to about 1200 BTU/stdcuft, but could optionally be of higher or lower heating value. For example, it could be a high heating value fuel such as a high hydrogen fuel or a lower heating value fuel such as a synthesis gas. In many cases, conventional fuel and synthesis gas can be fed interchangeably. The gas fed through the secondary gas inlet can be fuel, inert gas, or a combination of fuel and inert gas.

The venturi assembly sometimes includes a tubular portion downstream from the diverging portion, and the secondary gas inlet is formed on the tubular portion. In some cases, at least one of the flow direction and flow velocity is altered downstream from the secondary gas inlet. Alteration can be effected with a flow resistance component.

In some cases, an induced draft fan is included downstream from the outlet. Sometimes, a damper is included to provide additional control of the flow rate of air through the air inlet. In other cases, no damper is included. In many cases, fuels having a volumetric heating value in the range of about 100 BTU/stdcuft to about 1200 BTU/stdcuft can be used interchangeably.

Another embodiment is a method of firing a heater having at least one burner comprising a venturi assembly having an upstream air inlet, a converging portion with a primary injection fuel inlet, a throat portion downstream from the converging portion, a diverging portion downstream from the throat portion, and an outlet. A secondary gas inlet is disposed downstream from the converging portion and upstream from the outlet. The method comprises introducing fuel into the fuel inlet, the fuel inspirating air into the air inlet, and feeding a gas through the secondary gas inlet, wherein a mixture of air and fuel in a selected air to fuel ratio exits the venturi assembly through the outlet.

The venturi in certain cases has a resistance component positioned downstream from the secondary gas inlet. In some cases, such as when the fuel has a low heating value, the heater has a plurality of hearth burners and a plurality of wall burners and the method further comprises feeding at least a portion of the low heating value fuel through at least one additional port positioned in at least one of a first location adjacent to the hearth burners and a second location in the wall of the heater below the wall burners and above the hearth burners.

A further embodiment is a burner including a venturi assembly comprising an air inlet, a converging portion with a primary injection fuel inlet, a throat portion downstream from the converging portion, a diverging portion downstream from the throat portion, and an outlet. A secondary gas inlet is positioned downstream from the converging portion and upstream from the outlet.

Another embodiment is a firing control system for controlling the air to fuel ratio in a burner assembly having a venturi assembly comprising an air inlet, a converging portion with a primary injection fuel inlet, a throat portion downstream from the converging portion, a diverging portion downstream from the throat portion, an outlet, and a secondary gas inlet disposed downstream from the converging portion and upstream from the outlet. The firing control system comprises a first flow control device configured to control fuel inlet flow at a primary injection fuel inlet, and a second flow control device for controlling gas inlet flow at the secondary gas inlet. Sometimes, at least one of the first and second flow control devices is a valve or a pressure regulator. In some cases, a damper is included for assisting in control of the air inlet flow rate.

Yet another embodiment is a firing control system for a furnace comprising a hearth, a side wall, and a burner assembly with at least one burner including a venturi assembly comprising an air inlet, a converging portion with a primary injection fuel inlet, a throat portion downstream from the converging portion, a diverging portion downstream from the throat portion, an outlet, and a secondary gas inlet disposed downstream from the converging portion and upstream from the outlet. The firing control system includes a first flow control device configured to control fuel inlet flow to the primary injection fuel inlet and a second flow control device configured to control inlet flow to the secondary gas inlet. The flow rates through the first and second flow control devices are varied depending upon at least one of the composition of the fuel, the heating value of the fuel, the oxygen content at the burner outlet, and the desired air flow rate through the venturi assembly.

Sometimes the burner assembly includes at least a first set of staged burner ports on the hearth or wall, and the firing control system further comprises an additional flow control device configured to control inlet flow to the first set of staged burner ports. In this context, a "set" of stages burner ports can contain a single port or multiple ports. In some cases, a third flow control device is included that is configured to control inlet flow of a low heating value fuel at a second set of staged burner ports adjacent the first set of staged burner ports.

A further embodiment is a firing control system for a furnace comprising a hearth, a side wall, a furnace fuel inlet, and a burner comprising a venturi assembly with a first fuel inlet and a second fuel inlet. The firing control system comprises an oxygen analysis component configured to determine the post-combustion oxygen content of the furnace. The oxygen analysis component is used to adjust the relative fuel flow rates to the first and second fuel inlets of the venturi assembly.

Yet another embodiment is a firing control system for a furnace comprising a hearth, a side wall, and a burner with a furnace fuel inlet and a supplemental fuel inlet. The firing control system comprises a fuel analysis component configured to determine whether the fuel at the fuel inlet has a lower heating value or a higher heating value. The fuel analysis component is used to control the flow rate of fuel to at least one of the furnace fuel inlet and the supplemental fuel inlet.

Another embodiment is a furnace comprising a plurality of hearth burners, a plurality of wall burners, a first set of staged burner ports for at least one of the plurality of hearth burners and the plurality of wall burners, and a second set of staged burner ports adjacent the first set, wherein only the first set of staged burner ports is used with higher heating value fuels and wherein both the first and second sets of staged burner ports are used with lower heating value fuels.

DETAILED DESCRIPTION

Figure 1:
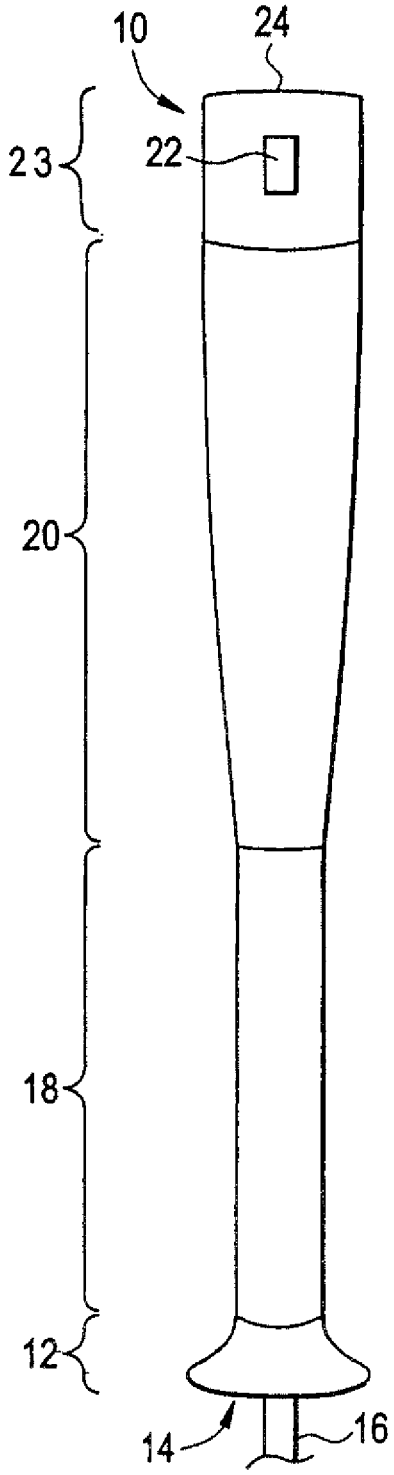
FIG. 1 schematically shows an example of a venturi assembly.

The embodiments described herein provide the flexibility to alternatively fire furnace fuels such as synthesis gas and conventional fuel sources in the same furnace. The disclosed embodiments enable a plant to easily switch between fuel sources should a disruption occur in the primary source. They also provide improved capability to control the total combustion air rate to the furnace and/or to easily adjust the air split between hearth and wall burners when using a single fuel or switching between fuels of widely different volumetric heating value. The embodiments are particularly well suited for use with ethylene furnaces but also can be used with other types of furnaces.

As used herein, "flow resistance component" means a device positioned proximate to or at a burner outlet that directs flow and/or changes flow velocity. "Fuel volumetric heating value" as used herein refers to the heat release with the complete combustion of a unit volume of that fuel. As used herein, "conventional fuel" refers to mixtures comprising methane, hydrogen, and higher hydrocarbons that exist as vapors as they enter the furnace. Non-limiting examples of conventional fuels include refinery or petrochemical fuel gases, natural gas, or hydrogen. As used herein, "synthesis gas" is defined as a mixture comprising carbon monoxide and hydrogen. Non-limiting examples of synthesis gas fuels include the products of the gasification or partial oxidation of petroleum coke, vacuum residues, coal, or crude oils.

Generally stated, a method of controlling the air to fuel ratio in a burner, a method of firing a heater, a burner, a furnace and control systems are described that provide for control of air flow without requiring the use of dampers or other devices, or provide for extended control in conjunction with dampers or the like. In many cases, the burner, methods and control systems can interchangeably use fuels having a wide variety of gaseous fuel volumetric heating values including those of methane/hydrogen mixtures and synthesis gas. Usually, the fuels have volumetric heating values in the range of about 100-1200 BTU/stdcuft, and in most cases about 200-1000 BTU/stdcuft.

One embodiment is a method for firing control of a burner. Gas, such as fuel or steam, is introduced through a secondary gas inlet at the downstream end of a venturi assembly containing premixed air and fuel. By varying relative amounts of fuel delivered through the primary fuel port and the gas to the secondary gas inlet at the same total fuel flow, the flow rate of air that is educted into the furnace can be varied. Thus, the system provides for air to fuel ratio control without varying the induced draft fan speed or using air flow dampers upstream of the venturi inlet. Another advantage is that flow control range can be varied by including various resistance components, or a single component with adjustable resistance, proximate the venturi outlet. It is typical to include a device for analyzing the oxygen in the burner effluent to determine the air flow.

Another embodiment is a method for firing control of a furnace, ft combines the individual burner control system encompassing the primary gas introduction into a venturi assembly and a gas inlet downstream of the diverging section but upstream of the outlet with additional fuel nozzles and control valves to allow for flexibility. Such a system can be configured to allow for firing control over a wide range of volumetric heating value fuels, and is particularly useful for designing burners to operate on various fuels ranging from conventional fuels, such as natural gas, to synthesis gas fuels.

Another embodiment is a burner comprising a venturi assembly. The burner includes a secondary gas inlet in the assembly downstream of the diverging section of a venturi of a premixed air to fuel hearth burner and/or wall burner. The secondary gas inlet usually is an injection port. In some cases, the secondary gas inlet is a tip located at the axial center of the venturi that directs fuel along the axis of the venturi assembly. The venturi assembly includes an air inlet, a primary fuel injection point, a converging section into which air or another suitable oxygen containing gas is inspirated, a throat, a diverging or expansion section for pressure recovery, and an outlet for emitting a fuel-air mixture into a furnace enclosure. A secondary gas inlet is located downstream from the throat and upstream from the outlet. The gas used in the secondary gas inlet may either be the furnace fuel or an inert gas such as steam or nitrogen. In many cases, a flow resistance component is included downstream from the secondary gas inlet and upstream from the outlet.

Current burners used in ethylene furnaces and the like are not able to switch between conventional fuel and synthesis gas because of the large variation in fuel and air rates between conventional fuel and synthesis gas. For example, the same heat liberation of synthesis gas requires a fuel rate which is five times larger than the fuel rate of a conventional methane/hydrogen fuel. The required air rate is 30% less, however. In a conventional furnace, a set of fuel ports sized for synthesis gas operation will not aspirate the correct amount of air required for operation using conventional fuel. Thus, two distinct burners, or two sets of internals for a given burner, would be required to allow for fuel switching. In the one case, this represents significant additional cost and in the other, a shutdown would be required to switch burner internals. Neither is desirable. In contrast, the disclosed embodiments allow for a single burner to handle both fuels by switching fuel from the inspirating port to the secondary gas port downstream of the converging section but upstream from the outlet or from a resistance component, if included. Furthermore, additional fuel ports can be included at the secondary tip position of the hearth burners, and on the wall for the wall burners, to allow for additional fuel flow for the lower volumetric heat release fuel. These can be activated by a signal from a fuel composition analysis online (for example a Wobbe meter). The use of the secondary gas port in the venturi allows for a stable flame to be maintained for both types of fuel. It also allows for a seamless transition to the use of a conventional fuel if a synthesis gas supply is suddenly lost, or vice versa.

The secondary gas port is sized to handle a large portion of the much higher synthesis gas fuel rate as compared to the conventional fuel rate, but can also be used with conventional fuels. By properly designing the fuel inspirating port, and secondary gas ports of the venturi assembly, and in some cases, by including a flow resistance component downstream of the secondary port, the system operates as a "fluidic valve," allowing for firing control for synthesis fuel and conventional fuel, and providing for easy switching between fuels.

The variables associated with the design of a venturi, including the throat length and diameter, the angle of the diverging section, etc are all operative and are used to set the overall design point for the air flow. The ratio of primary to secondary fuel injection and the downstream resistance are then used to define the control range around the design point. Furthermore, the exact point along the length of the venturi assembly where the secondary gas enters and the direction of that gas entry both impact the quantity of air inspirited under any given conditions.

Another advantage of the embodiments described herein is that they provide an improved capability to control total air rate and the air split between hearth and wall burners by varying the gas rate and gas type to the secondary gas inlet. This is for any given fuel. In conventional burners, the air rate is controlled by adjusting air damper position in the inlet air plenum. This is a time consuming control technique that sometimes is imprecise. With conventional technology, fuel can be switched from the staged fuel ports to the venturi throat port to control air but this can significantly alter the flame shape and in an ethylene furnace adversely affect the tube metal temperature and run length. The advantages of the secondary gas inlet are that this new port facilitates control of the air flow through a given burner without a change in the total fuel flow to that burner and without requiring changes in damper positions or induced draft fan speed. By moving fuel between the throat and a secondary port on the venturi, the air rate, which is inspirated through the venturi, can be adjusted without changing the total fuel flow through the venturi and thus without changing the heat input to the process. Further, the fuel is introduced at the same point within the combustion zone of the burner. This will minimize the impact on flame shape while providing air split control and control of maximum tube metal temperature and temperature profile. Additionally, by introducing an inert gas, instead of fuel, in the secondary gas inlet, the total air flow rate can also be adjusted without changes in primary fuel flow and damper settings, and without effecting burner flame shape.

A further advantage of the secondary gas inlet in the venturi assembly is that this new port facilitates a rapid transition between two dissimilar fuel sources when operating an ethylene furnace. Because of the very different heating values of convention fuel and synthesis gas, the synthesis gas fuel rate needed for constant firing is about five times higher than that of the conventional fuel rate. The air rate with synthesis gas, however, is about 30% lower. Use of a secondary gas port on the venturi allows operation with both types of fuel because the same size primary fuel injection port and venturi throat geometry could be used to inspirate the correct amount of air.

Currently, dampers in the air inlet passages are used to adjust air flow to changes in combustion conditions or slight variations in fuel gas composition while trying to maintain a constant heat input to the heater to maintain constant process performance. Combustion performance is usually monitored by analysis of the effluent flue gases for oxygen content and operators attempt to control to a given level of oxygen thus controlling the air/fuel ratio. The dampers are adjusted by hand and/or using mechanical linkages called jackshafts that are cumbersome and not sensitive to small changes. In some cases, dampers can be elevated when the new burners are used.

Referring to the figures and first to FIG. 1, a venturi assembly is shown and is generally designated as 10. The venturi assembly 10 has an upstream converging portion 12 with an air inlet 14 and a primary fuel inlet 16. The downstream end of the converging portion 12 is connected to a throat 18. A diverging portion 20 is connected to the downstream end of the throat 18. A secondary gas inlet 22 is positioned downstream from the converging portion 12. In the embodiment shown in FIG. 1, the secondary fuel inlet 22 is disposed on a tubular portion 23 downstream from the diverging portion 20 and upstream from an outlet 24. The secondary gas inlet 22 is configured to receive either an inert gas or additional fuel. The secondary fuel inlet typically is a tube oriented such that the gas is fed axially along the venturi centerline. By adjusting the flow rate and substance introduced into the secondary gas inlet 22, the air to fuel ratio in the venturi assembly and at the outlet 24 can be controlled.

Figure 2:
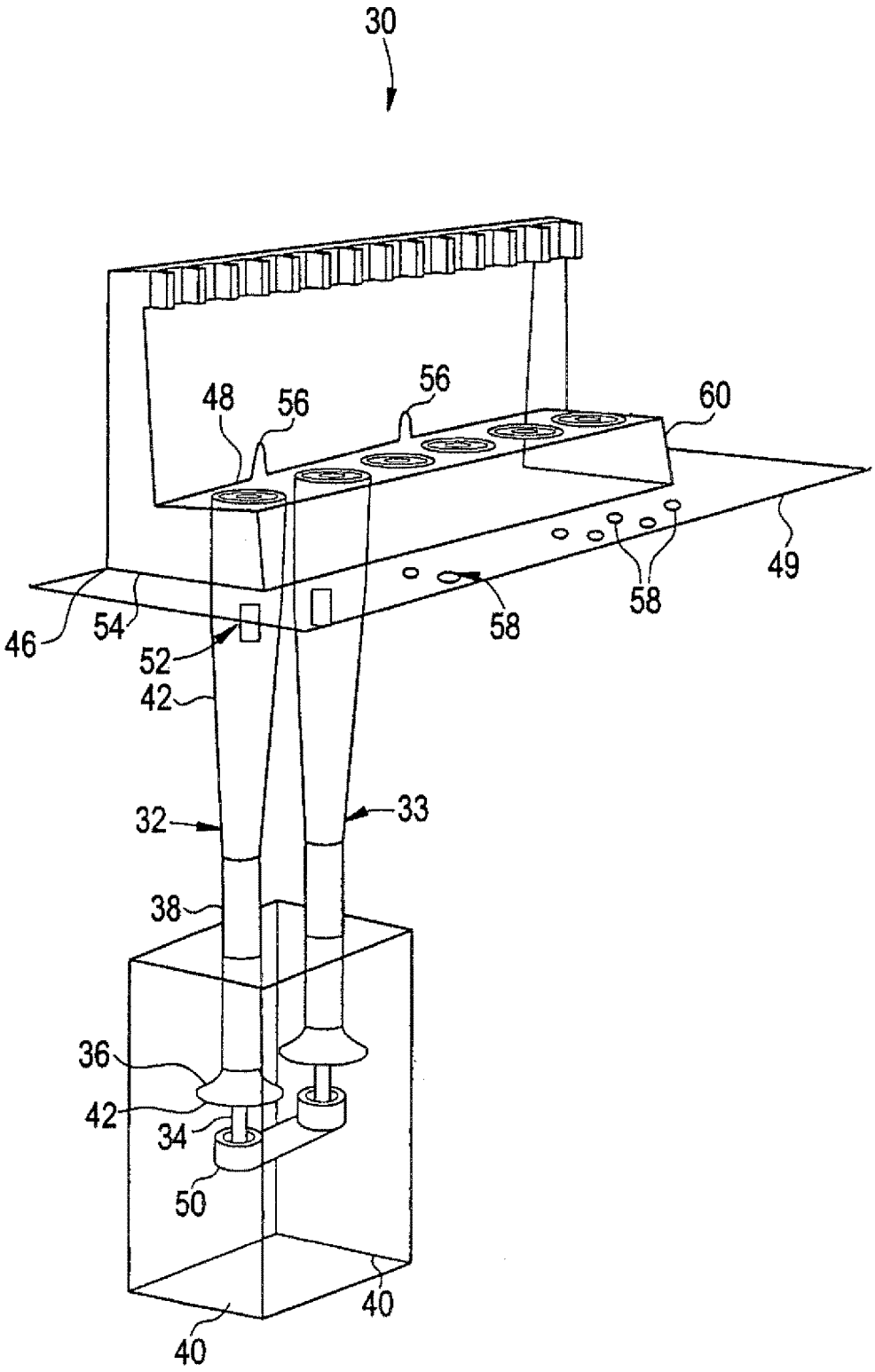
FIG. 2 schematically depicts an example of a hearth burner for a furnace.

FIG. 2 shows an exemplary hearth burner assembly 30 for a cracking furnace. A hearth burner assembly in general consists of a refractory tile that provides a housing for the metal internals of the burner and acts as a thermal shield for those metal parts. Within the tile, there are provisions for injecting fuel, controlling the direction of the air and or fuel flow, and controlling the turbulence to allow for flame stability. FIG. 2 shows a burner tile 60 with internals as described above consisting of venturi assemblies and fuel injection ports. A total of 6 venturis are used in this burner and FIG. 2 shows two venturis 32, 33. There can be any number of venturis in parallel and typically there are about one to six. In venturi 32, fuel is injected through the primary fuel injection port 34 in the converging section 36. The jet from this port creates a low pressure in the venturi throat 38 which inspirates combustion air into the venturi assembly through the air inlet 40 and into an annular air inlet 42 in the converging portion 36. The fuel and air mix in the venturi throat 38 and flow through the diverging portion 42 and into the burner tile 60 of the furnace. The fuel and air mixture passes through an optional resistance component 46, such as a grill, and exits the venturi assembly 32 at the venturi outlet 48. The outlet 48 typically does not protrude above the upper horizontal surface of the tile 60. The hearth burner assembly as shown also includes secondary staged fuel ports 58 and tertiary stage fuel ports 56. These staged fuel ports are typically located outside of the confines of the tile enclosure itself but pass through the edges of the tile. They inject fuel at an angle into the mixture of fuel and air exiting the confines of the tile enclosure. The fuel that passes through these ports is considered part of the total fuel for the hearth burner.

If an optional air damper 50 is included, air flow can be partially manually controlled by adjusting the vertical position of the air damper 50. Whether or not air damper 50 is included, air flow is further controlled through the injection of fuel, inert gas, or a mixture of fuel and inert gas through at least one secondary gas inlet 52 positioned downstream from the converging section and upstream from a venturi outlet 48.

In FIG. 2, the secondary gas inlet 52 is positioned at the downstream end of the diverging portion 42 of the venturi assembly and below the surface of the tile 49. This enables convenient delivery of the gas at an accessible location. By including at least one secondary gas inlet 52, additional fuel or an inert gas can be added to the system at this location. This inlet can be employed, for example, when the fuel being used has a low air to fuel stoichiometric ratio, such as for synthesis gas, or when the fuel being used has a high air to fuel stoichiometric ratio, such as a conventional methane-hydrogen fuel. For some fuel types, the secondary gas inlet may not be used. However, it is present in order to accommodate a variety of fuel types in a single burner.

The secondary gas inlet 52 can be positioned anywhere downstream of the converging section 36 of the venturi assembly, and usually is positioned in the diverging section 42 or the tubular section 54 that is downstream from the diverging section 42. More than one secondary gas inlet can be included in a single venturi. In some cases, the secondary gas inlet 52 is positioned near the venturi outlet in order to avoid disrupting the pressure recovery in the diverging section 42. Although not shown in FIG. 2, the tube that feeds the secondary gas inlet 52 would enter though the side wall of the venturi channel and turn upwards.

The resistance component 46 is sized not just for directing flow or minimizing flashback, but also for controlling the range of the air flow by providing a pressure drop under varying secondary port flow rates. The pressure drop impacts the pressure downstream of the venturi at constant venturi inspiration flow, thus impacting the flow rate of inspirated air.

Figure 3:
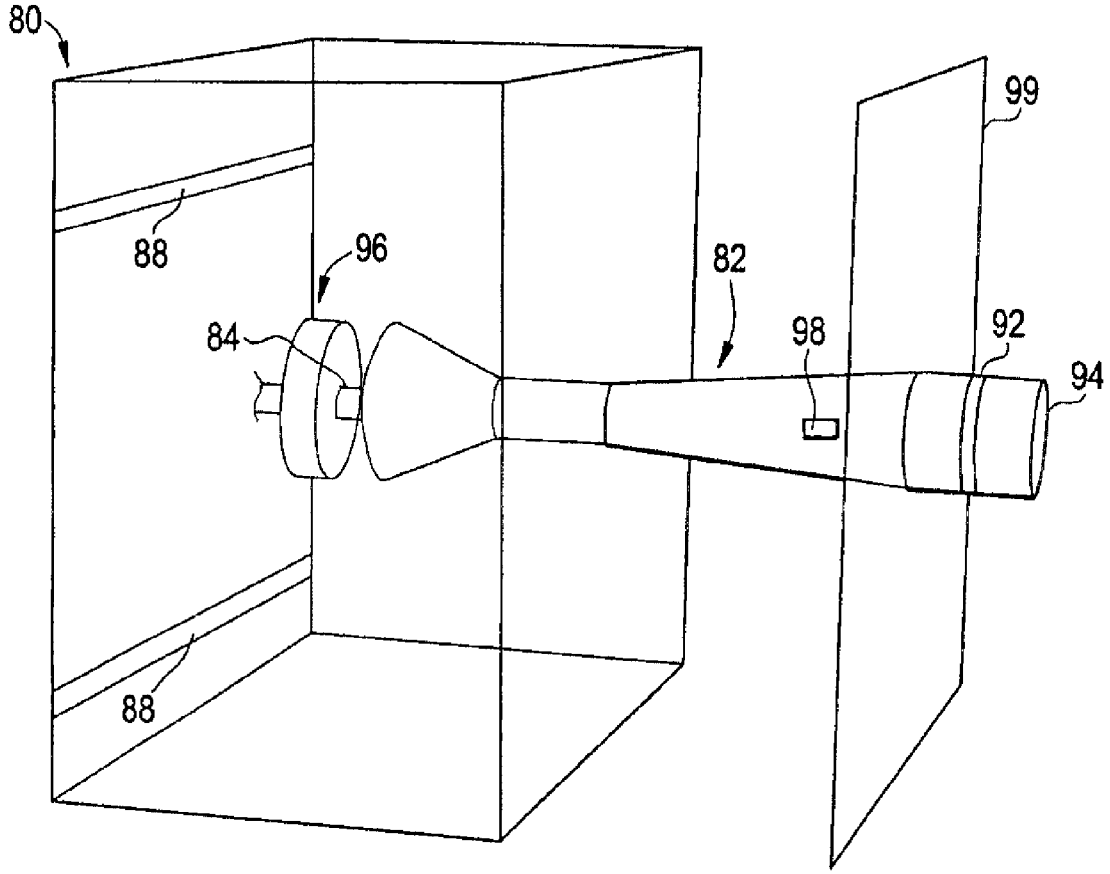
FIG. 3 schematically shows an example of a wall burner.

FIG. 3 shows an example of a wall burner assembly 80 for a cracking furnace provided with a venturi assembly 82. There can be any number of venturis in parallel. Typically in ethylene furnaces each wall burner has one venturi assembly. Multiple wall burners can be located on the walls of the ethylene furnace. In venturi 82, fuel is injected through the primary fuel port 84 and combustion air is inspirated into the venturi assembly through the air inlets 88. The fuel and air mix in the venturi and flow into the furnace through the orifices 92. The flow is directed radially along the walls of the furnace by employing a cap 94 on the venturi outlet. The combination of the size of orifice 92 and flow direction change created by cap 94 generate a pressure drop. This combination provides for control of the flow as well as increasing the velocity of the mixture as it enters the furnace to avoid flashback. If the optional air damper 96 is included, air flow can be partially manually controlled by adjusting the vertical position of the air damper 96. Whether or not air damper 96 is included, air flow can be further controlled through the injection of fuel, inert gas, or a mixture of fuel and inert gas, through at least one secondary gas inlet 98 positioned downstream from the converging section. In FIG. 3, the secondary gas inlet 98 is positioned in the diverging section near but upstream from the furnace wall 99. By including at least one secondary gas inlet 98, additional fuel can be added to the system at this location when the fuel being used requires a low air to fuel ratio, such as synthesis gas, and an inert gas (or no gas) can be added at this location when the fuel being used requires a higher air to fuel ratio, such as a conventional methane-hydrogen fuel.

The venturi assembly, burner assembly and methods provide the flexibility to control the air rate through hearth and/or wall venturis to achieve the following goals:

(a) With any type of fuel, use of the secondary gas inlet in both hearth and wall burners permits variation of the air split between the wall and hearth burners while maintaining constant total fuel and air rates to the furnace. A constant fuel rate to the hearth burners and a constant fuel rate to the wall burners also can be maintained. This level of control is useful to limit the maximum tube metal temperature and to extend run length. Reduction in maximum metal temperature can be achieved at constant firing by increasing the air to fuel ratio in the hearth burners and decreasing this ratio in the wall burners. The use of a secondary gas inlet permits this to be done in the following manner:

(1) To increase hearth air rate, fuel is diverted from the secondary gas inlet of the venturi assembly in the hearth burner to the throat port of the hearth burner. The greater flow of primary injection fuel results in increased inspiration in the venturi and a larger air flow. Since the increased fuel to the throat of the hearth venturi comes from the secondary gas port, the total fuel to the hearth venturis remains unchanged. This minimizes impact on flame quality.

(2) To maintain total air rate constant, the opposite is done in the wall burners, i.e., fuel is removed from the wall burner venturi throat primary injection port and moved to the secondary gas inlet in the wall burner venturi assembly. This reduces the inspirated wall burner air, reduces the total air through the wall burners, and keeps the total wall burner fuel constant. The net effect is to increase the air rate in the hearth burners, decrease the air rate in the wall burners, and maintain total air constant. On the fuel side, hearth and wall burner fuel rates are unchanged. This minimizes the effect on flame shape and the possible adverse effect on tube metal temperature.

b) As an alternate to shifting fuel, an inert gas, such as nitrogen or steam, or a mixture of inert gas and fuel can be used in the secondary gas port. By increasing the total flow (air plus fuel plus inert gas) through the resistance and the outlet, the pressure profile over the venturi will be changed. The pressure downstream of the throat will be increased and thus for a constant primary injection inspiration flow, the air flow will be reduced. Thus, control is provided to adjust the total air rate to the furnace without changing the total fuel rate. Computer simulations show that, depending on the resistance coefficient of the resistance component located at the venturi outlet, an increase in gas flow through the secondary gas port can either increase or decrease the air rate through the venturi. Thus, the venturi can be designed, with this port as an integral part, to permit air flow variation over a desired range. This can be done without having to adjust damper position settings. This provides for improved accuracy and efficiency in system adjustment as compared to those that only use dampers.

A new firing control system for a burner is provided herein. Typically, the fuel for a set of burners passes through a header system that may or may not have individual flow control devices to control the fuel flow hence the heat input to the furnace. The gaseous fuel flow is typically controlled by adjusting the pressure in the header, and thus the flow over the resistances of the small fuel orifices in the burner is determined. Lower header pressure equals lower flow. The air flow is controlled by means of dampers, speed of induced draft fans, or by direct control of the flow of air from blowers providing positive pressure flow to the burner or by combinations of the above. A new technique of air flow control is described herein.

The ratio of fuel to the primary fuel port and the secondary gas port of the venturi assembly allows for changes in air flow through the venturi. As is described above, the air flow to individual burners can be controlled by changing these ratios. For the case with both wall and hearth burners, the fuel flow rate to the hearth burner primary injection port can be increased while the fuel flow rate to the secondary port in the venturi assembly is decreased, thus increasing the air educted by the hearth burner. Similarly, the fuel to the primary port of the wall burner can be reduced and the fuel to the secondary port in the wall burner venturi assembly increased, thus reducing the air educted by the wall burners. In total, at a constant fuel flow rate to the furnace, one can change the ratio of air flow split between the hearth and wall without changing the overall fuel flow or overall air flow.

If the total air flow to the furnace is to be increased or decreased without adjusting the split of air flow between the hearth and wall burners, the flow to the primary injection ports in both the wall and hearth venturis can be increased or decreased with subsequent adjustment to the secondary venturi assembly gas inlets to maintain constant fuel flow.

In one embodiment of the firing control system, the flow rates through the first and second flow control devices are varied depending upon at least one of the composition of the fuel, the heating value of the fuel, the oxygen content at the heater outlet, and the desired air flow rate through the venturi assembly.

Figure 4:
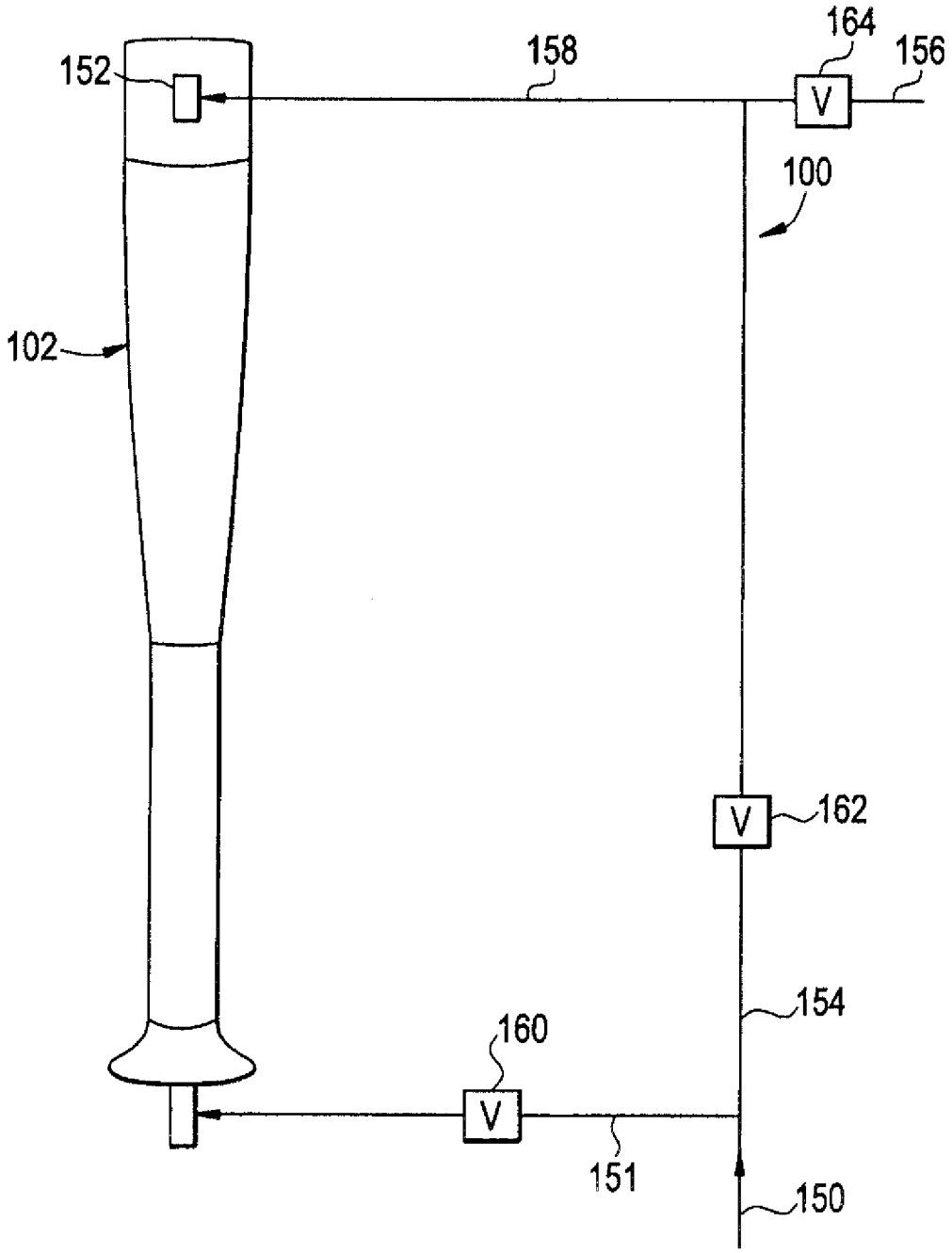
FIG. 4 schematically shows an example of a firing control system that allows for air to fuel ratio control for a single fuel.

FIG. 4 shows a control system 100 for a venturi assembly 102 configured to fire a single type of fuel. A main fuel line 150 divides into a primary fuel line 151 and a secondary fuel line 154. The primary fuel line 151 has a flow control valve 160. The secondary fuel line 154 has a flow control valve 162. In some cases, an inert gas line 156 with a flow control valve 164 connects with the secondary fuel line 154 downstream of the flow control device 162 to form inlet line 158, which introduces fuel and/or gas at the secondary gas inlet 152. The fuel control system can be combined with the conventional control system variable (ca induced draft fan speed) to achieve even wider range of control. Since control of air to fuel ratio can be achieved using flow control devices such as pressure regulators or flow valves, this system can be configured for remote or computer control. The speed of the fan can be used to vary the pressure inside the furnace (draft) and thus change the pressure profile over the venturi assembly and thus change the flow of air through the venturi assembly. These devices work in response to a measure of air flow or air/fuel ratio such as an oxygen analyzer.

Figure 5:
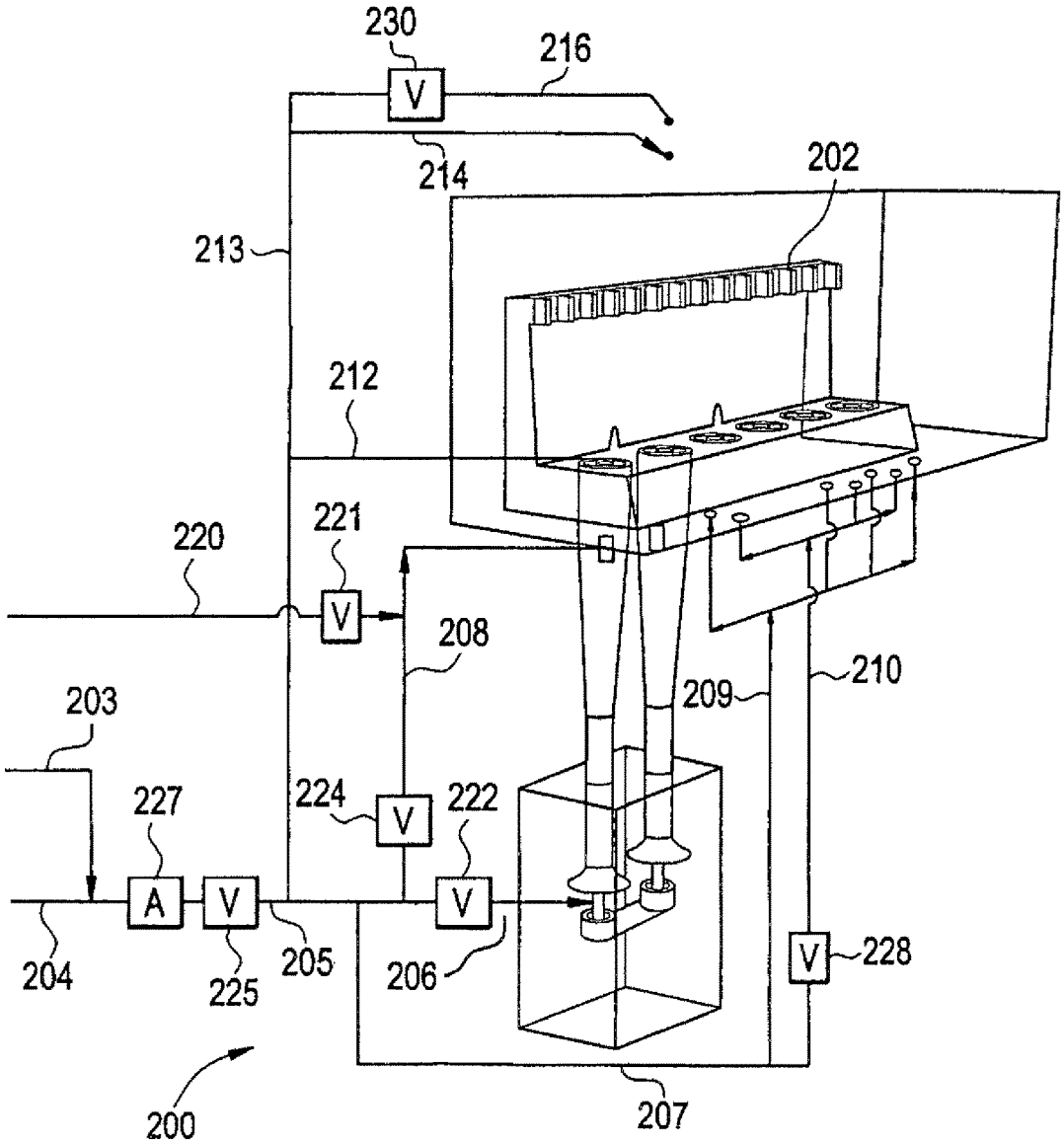
FIG. 5 schematically shows an example of a firing control system that allows for the operation of a furnace capable of alternatively firing two different volumetric heating value fuels and for switching between the two fuels.

FIG. 5 schematically shows an example of a firing control system, designated generally as

200, for a hearth burner 202 configured for alternatively firing fuels with significantly different heating values. A similar system can be used for a wall burner. This system is designed to allow for controlled firing of two fuels with widely different heating values. The system combines the venturi control system with an analytical device and allowances for additional tips to handle the higher volume flow of the lower heating value fuel. These are turned on as the fuel composition changes to allow for the same heat input at higher total volume flow. As is shown in FIG. 5, a first fuel is fed through fuel line 204. A second fuel can be fed through a second fuel line 203. These fuel lines usually are used to alternatively deliver different types of fuel into fuel line 205. Fuel line 205 supplies fuel for a primary venturi injection fuel line 206, a secondary venturi assembly gas line 208, an optional secondary staged tip fuel line 209 located outside of the venturi assembly, an optional fuel line 210 for a second row of secondary staged tips, an optional tertiary staged tip fuel line 212, an optional primary wall stabilization (WS) tip fuel line 214, and an optional secondary wall staging tip fuel line 216. In some cases, an inert gas is fed through the secondary venturi assembly gas line 208 from inert gas line 220. Line 220 utilizes flow control device 221.

The control system includes a first flow control valve 222 in the primary fuel line 206 and a secondary flow control valve 224 in the secondary gas line 208. Located in the main fuel line 205 is a device to control the total fuel flow to the header system described above. This can be a flowmeter, pressure regulator or other similar device 225. Also located in the fuel line 205 is a fuel composition or heating value analytical device 227 that determines the heating value of the fuel being fed to the system. Computerized control of the relative flow rates through lines 206 and 208 by ratio control or another suitable technique allows for automatic and rapid adjustment of fuel/air ratios. This shift can occur based upon either fuel composition or oxygen analysis in the effluent. It is desirable to control flow rates to a point where there is a small amount of oxygen remaining (typically 2% representing 10% excess air).

The pressure at various locations in the venturi determines the flow rate of air inspirated into the venturi. Flow rates of fuel in lines 207, 209, 212, 213 and 214 typically are part of a more conventional control system where the flow is set by the pressure in the header system and the dimensions of the fuel orifices in these lines, or flow can be determined by port size. In a conventional control system, the flow in line 206 would also be controlled by the header pressure and would not have a control device. In the system disclosed herein, lines 206 and 208 utilize flow control devices 222 and 224 as described above. Line 210 utilizes flow control device 228. Line 216 utilizes flow control device 230. The secondary staged tips (line 210) and secondary wall stabilization tips (line 216) are used for the flow of the fuel with the lower heating value. In order to maintain a constant heat input to the heater, a much higher volume of fuel flow is required than for the higher heating value fuel. The volume of the lower heating value fuel may be as much as 4-5 times higher than for the higher heating value fuel. For a wide range of fuel volumetric heating values, the pressure required to pass this higher volume flow through fixed orifices would be excessive. The analytical device 227 continually monitors the heating value and/or fuel composition in line 205. An example of such a device is a Wobbe meter. If analytical device 227 senses a low heating value fuel, the lines 210 and 216 can be opened by solenoid operated valves 228, 230 or their equivalent, respectively, that activate based on fuel composition. Conventional or higher heating value fuels would use lines 209 and 214 the flow would be set by pressure in the header 205. For the lower heating value fuel valves 228 and 230 might be opened and header pressure might be used to control the flow there. By adding flow area (more ports) the flow can be larger at similar pressure in header 205. It is noted that pressure regulators or other suitable devices can be used in place of flow control valves.

Through the use of flow control devices (e.g., flow control valves or pressure regulators for example), the flow ratio between the primary venturi port and the downstream secondary venturi port can be adjusted to achieve air flow control and thus control of the air to fuel ratio. The flow to the secondary port of the venturi assembly can include an option for use of a gas other than fuel. It is noted that pressure regulators are the preferred devices since the pressure in the headers (either line 205 or individual lines 206 and 208) determines the flow of fuel with fixed orifices in the fuel injection tips.

In one embodiment, the control system of FIG. 5 activates flow control valves by detecting significant changes in fuel gas composition. These differences can be detected "online" by the use of instrumentation such as a Wobbe meter that determines the heating value of the fuel gas. If the volumetric heating value of the "new" fuel gas is such that there will be limitations due to the geometry of the existing ports and pressure available for flow, these additional ports (in the secondary staged port position or on the wall or elsewhere in the firebox) can be opened and the additional volume added to the firebox. It is noted that variations are possible in the location of the fuel ports.

Control of the air flow through the use of a fluidic valve-type system of the type disclosed herein minimizes the requirement for continual adjustment of dampers or induced draft fans currently used to control air flow. The control of dampers on the many burners that exist within typical furnaces involves the use of jackshafts that are cumbersome and not readily amenable to external control. Jackshafts can not be employed easily on wall burners. This external control of the air to fuel ratio in the heater (used to control overall furnace efficiency by managing excess air and individual flame patterns by specific adjustments to individual dampers can be simplified by controlling fuel flow devices (pressure or flow) externally.

A further embodiment is a furnace comprising a plurality of hearth burners, a plurality of wall burners, a first set of secondary staged tips for the hearth burners, and a second set of secondary staged tips for the hearth burners. Only the first set of secondary staged tips is used with higher heating value fuels, while both the first and second sets of secondary staged tips are used with lower heating value fuels. In many cases, the hearth burners are configured to interchangeably operate with high heating value fuels and low heating value fuels. The overall performance of the furnace would be monitored by analytical devices on the process performance and by analysis of the oxygen and other flue gas components in the stack of the furnace, if for example, the process called for increasing or decreasing the process duty, the total fuel pressure in the header could be raised or lowered to provide more fuel. In response, the ratio of firing between the primary and secondary inlets in the venturi assembly could be adjusted to provide higher or lower air flow as required to maintain a specified level of oxygen within the furnace for optimum performance of the whole furnace (slight excess).

The following examples are included to illustrate certain aspects of the disclosed embodiments but are not intended to limit the scope of the disclosure.

Example 1

A computational fluid dynamics (CFD) simulation was conducted for a furnace employing both hearth and wall burners using venturi burner assemblies in which varying amounts of fuel were injected through the primary port and through the secondary gas port. The CFD simulations for all examples were performed using Fluent, a commercially available software package from Fluent, Inc. Other software packages can be utilized to recreate the results described herein. The set of hearth burners had a total of 12 venturi assemblies and the wall burners had a total of 18 venturi assemblies. The venturi assemblies for the wall burners had a larger flow capacity than those for the wall burners. The fuel was a higher volumetric heating value fuel at 832 BTU/stdcuft fuel. There were no resistance components included at the venturi outlets. The air flows through the assemblies were calculated as well as the maximum tube metal temperature of the heating coil. The results are shown below on Table 1.

TABLE 1

| | Example No. | | |
|---|---|---|---|
| | 1A | 1B | 1C |
| | Fuel(kg/sec) | | |
| Hearth fuel | | | |
| Venturi Throat | .0974 | .1363 | .1908 |
| Venturi Second port | .0934 | .0545 | 0 |

TABLE 1-continued

| | Example No. | | |
|---|---|---|---|
| | 1A | 1B | 1C |
| Secondary staged fuel | 0.0629 | 0.0609 | 0.0609 |
| Tertiary staged fuel | 0.0115 | 0.0115 | 0.0115 |
| Total: | 0.2652 | 0.2652 | 0.2652 |
| Wall fuel | | | |
| Venturi Throat | .360 | .324 | .265 |
| Venturi Second port | .0342 | .0702 | .1292 |
| Total: | .3942 | .3942 | .3942 |
| | Air (kg/sec) | | |
| Hearth air | 5.043 | 5.492 | 6.069 |
| Wall air | 7.200 | 6.76 | 6.042 |
| Total: | 12.24 | 12.25 | 12.10 |
| Maximum | | | |
| Tube Metal T, K | 1300 | 1288 | 1270 |

As can be seen by Table 1, as the fuel is shifted from the primary to the secondary venturi ports for the hearth and wall burner venturi assemblies, the air flow from the hearth burners is increased while the air flow from the wall burners is decreased. The fuel to the secondary staged tips in the hearth burner remains unchanged. As is also shown on Table 1, the maximum tube metal temperature decreased when air was moved from the wall burners to the hearth burners by shifting hearth and/or wall fuel using the secondary port.

Example 2

A CFD simulation was conducted for a venturi assembly with a grill at the outlet in which the secondary port flow of gas was varied. The gas used was steam. The flow of primary injection fuel was constant. The inspirated air rate was determined as a function of the steam rate through the secondary port and grill resistance coefficient. The results are shown on FIGS. 6 and 7.

Figure 6:
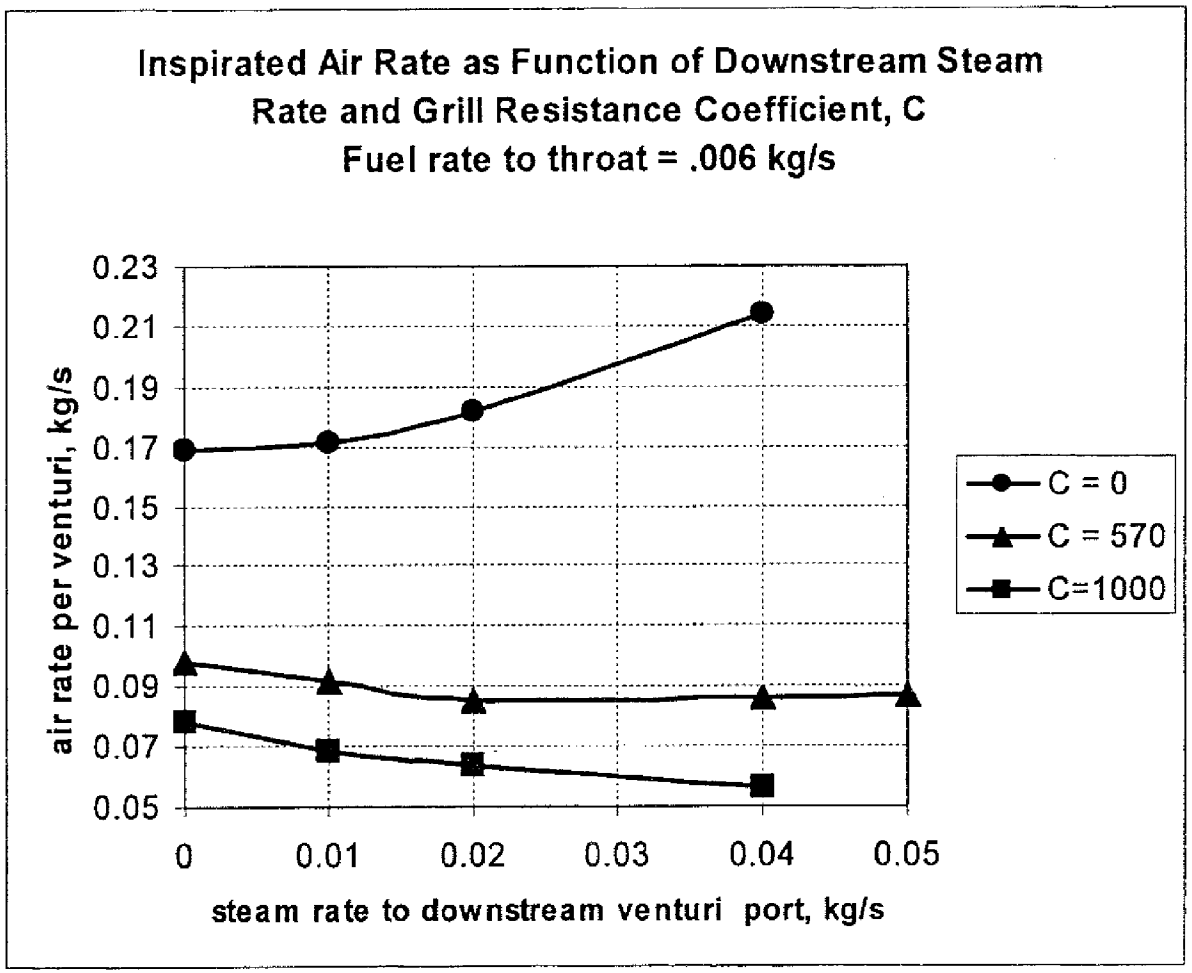
FIG. 6 shows the results of a computational fluid dynamics simulation showing the effect of secondary port flow and downstream resistance on air flow in one embodiment using a secondary gas other than fuel.

As shown on FIG. 6, the pressure drop though the downstream end of the venturi depended upon the resistance coefficient of the resistance component. The resistance coefficient C is defined as pressure drop across the resistance component divided by the velocity head of the flow. This is shown in the equation below $$\Delta P = C\rho V^2$$

where P is the ΔP is the pressure drop, ρ is the gas density, and V is the gas velocity.

When no flow resistance component was included, resulting in a resistance coefficient C of 0, the flow rate of air inspirated into the air inlet of the venturi increased as the steam rate through the secondary gas port increased. This was because the introduction of steam increased the velocity of the air-fuel mixture, thereby decreasing the pressure in the throat of the venturi. Since the overall pressure drop through the burner remained the same (ambient to inside furnace pressure) the lower pressure pressure in the throat resulted in a greater air inspiration flow rate.

When the flow resistance component had a resistance coefficient of 570, the flow rate of air inspirated into the venturi stayed about the same as the stream rate into the secondary gas port increases, because the pressure drop across the resistance component was compensated for by a higher upstream pressure in the diverging section of the venturi, resulting from increased air flow in the throat of the venturi. When the flow resistance component had a resistance coefficient of 1000, the flow rate of air inspirated into the air inlet of the venturi decreased as the flow rate into the secondary gas port increased, because a higher pressure (lower velocity) was needed in the diverging section of the venturi to compensate for the larger pressure drop across the resistance component.

Figure 7:
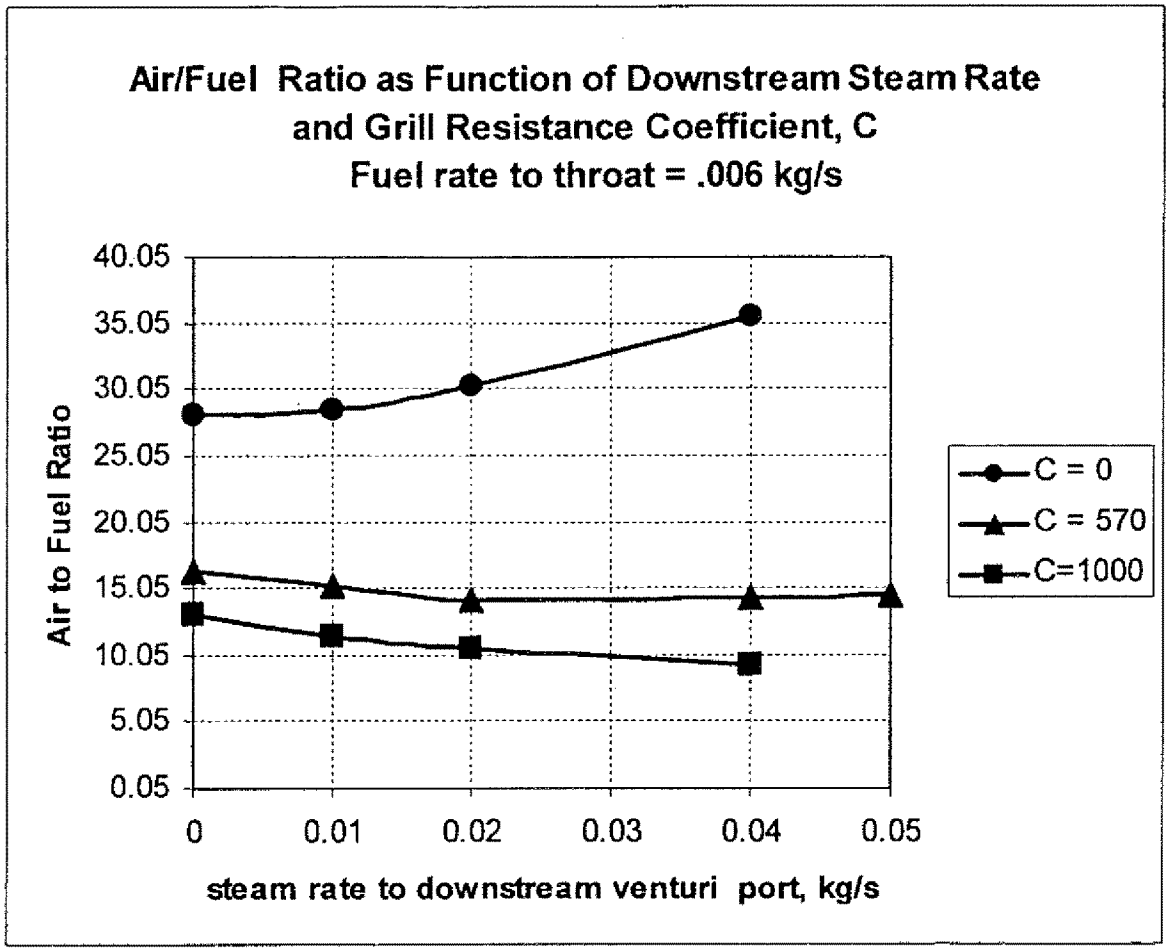
FIG. 7 shows the results of a computational fluid dynamics simulation showing the effect of secondary port flow and downstream resistance on air flow, expressed as an air-fuel ratio using a secondary gas other than fuel.

FIG. 7 shows a plot of the same data of FIG. 6, but with air to fuel ratio shown on the Y axis. This graph shows that the air to fuel ratio can be controlled by introducing an inert gas such as steam at the downstream end of the venturi.

Example 3

A CFD simulation was conducted of the control of a venturi assembly in which the secondary port flow of gas in a venturi was varied while maintaining the total fuel constant. This represents the flow control that can be achieved with a constant heat input to a furnace. The gas used was a lower heating value fuel. The inspirated air rate was determined as a function of the percent of the total fuel fed through the secondary port, the diameter D of the throat, and grill resistance coefficient. The results are shown on FIG. 8.

Figure 8:
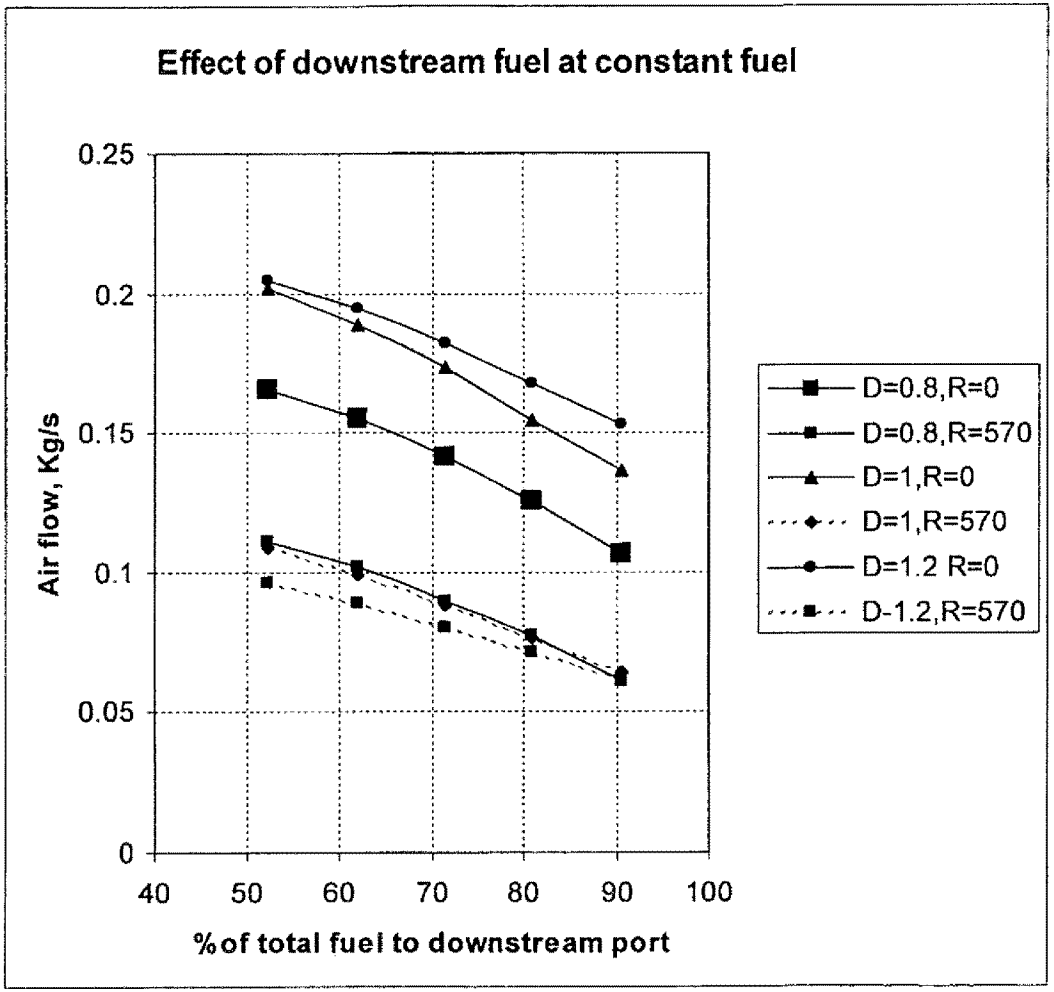
FIG. 8 shows the results of a computational fluid dynamics simulation showing the effect of secondary port flow and downstream resistance on air flow rate when fuel is added in the secondary venturi port.

As can be seen from FIG. 8, as the percentage of the total fuel is changed from primary to secondary tip, the air flow varies by approximately 30% over the range considered. The design variables of venturi diameter and flow resistance magnitude can be adjusted to move this control range to a number of differing absolute air flow rates.

Figure 9:
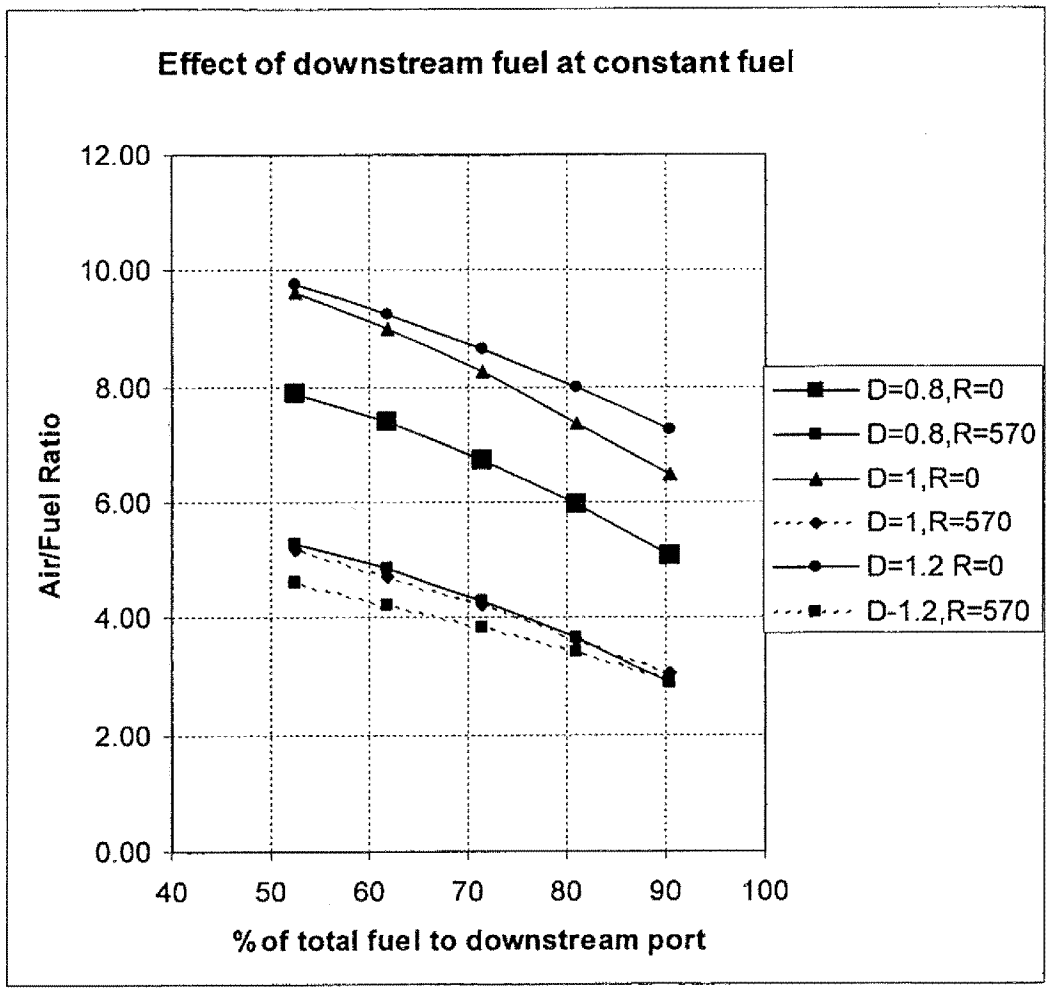
FIG. 9 shows the results of a computational fluid dynamics simulation showing the effect of secondary port flow and downstream resistance on air to fuel ratio when fuel is added in the secondary venturi port.

FIG. 9 presents these results in terms of air to fuel ratio. Whether the resistance coefficient C was 0 or 570, the air to fuel ratio increased as the percentage of the total fuel to the downstream end of the venturi decreased.

By shifting a greater percentage of the fuel to the primary injection point, more air is inspirated and the air-fuel ratio increased. This shows that the air-fuel ratio can be controlled for a given fuel at a constant heat input to a heater.

Example 4

A CFD simulation was run to determine the feasibility of using the a single firing system including fuel injection ports with fixed orifices in all of the fuel inlet to fire both a conventional high volumetric heating value fuel and a synthesis gas low volumetric heating value fuel in the same system. The conventional fuel was 90 mol % CH4, 10 mol % H2. The synthesis gas was 43.6 mel % CO, 37.1 mol % H2, and 19 mol % CO2. The firing rate was 225 MMBTU/hr LHV (lower heating value). Case 4A used convention fuel and Case 4B used synthesis gas.

The cases were run in a multi burner model representing half of a furnace. The hearth burners incorporated the venturi assembly of FIG. 1 with a grill resistance to prevent flashback. The wall burners employed the venturi assembly of FIG. 1. The wall burners included a porous jump at the plane at which the primary throat fuel was added. This simulated the use of a damper upstream of the fuel injection point.

The process fluid entered the radiant zone of the heater at equivalent conditions for all cases. The furnace employed both wall stabilization tips (two rows—reference lines 214 and 216 in FIG. 5) and two rows of secondary staged tips (inner and outer—reference lines 209 and 210 in FIG. 5). The results of this simulation are shown in Table 2.

For case 4A, the conventional fuel, the system was operated with the valves to the secondary row of staged tips and secondary wall fuel tips closed. Since this fuel has a higher heating value, the volume flow is lower and these are not required. The hearth burners operated with fuel in the primary injection port and none in the secondary port of the venturi assembly. Thus valve in line 208 (FIG. 5) was closed. The air/fuel ratio for the total furnace was 19.36. This ratio represents 9.3% excess air. The hearth burners operated at a combined air-fuel ratio of 21.57. The wall burners also operated with fuel in the primary injection port and none in the secondary port of the venturi assembly. There was a small amount of fuel fired through the primary wall stabilization tips to stabilize the flame and hold it against the wall (WS). The wall burners also operated at an air-fuel ratio slightly above stoichiometric considering only the air and fuel that went through the venturi assembly. There was flow to the inner row of secondary staged tips on the hearth burner but none to the outer row of secondary staged tips. The pressure in the header (line 205 in FIG. 5) was determined to be 39.5 psig to reach the desired fuel rates for these orifices.

When available, it is economically advantageous to employ the lower heating value synthesis gas fuel. The synthesis gas has a higher molecular weight but lower heating value on a volumetric basis. A composition meter can sense these differences and make the following changes. The valves to the outer row of secondary staged tips and second row of wall stabilization tips are opened to allow for the higher mass flow (valves 228 and 230 on FIG. 5). The heater is then balanced (by computer control if desired) by adjusting the pressure in the main header line 205 in FIG. 5 (to control total fuel input) and the ratio of the flows between the primary and secondary ports in the venturi assembly lines 206 and 208 in FIG. 5 are adjusted by adjusting valves (222 and 224 in FIG. 5). The balanced flows are shown as case 4B. It is important to note that there was considerable flow increase in the secondary venturi ports for both the hearth and wall burners. For the synthesis gas case, the primary tip injection flow for the wall burners was stopped since the required lower amount of air can be achieved via furnace draft only. The secondary staged tips saw a substantial amount of flow and the most of the additional wall stabilizing fuel flow was through the secondary wall stabilization tips. The pressure in the header was determined to be 34.9 psig. No change in air damper position or induced draft fan speed was required.

The process conditions remained identical. The Coil Outlet temperature (indicative of performance is constant at essentially 1095K. The oxygen content in the furnace outlet is equivalent (1.86 vs 2.0% O2 in the stack). Note that further slight trimming is always possible.

This example shows the ability of the venturi assembly system to switch from one fuel to another under control without requiring any changes in hardware and without impinging on performance of the process.

TABLE 2

| | Example No. | |
|---|---|---|
| | 4A Conventional Fuel | 4B Syngas Fuel |
| Process Conditions | | |
| Feed rate, kg/s | 7.4 | 7.4 |
| Crossover T, K | 839 | 839 |
| S/O | .4 | .4 |

TABLE 2-continued

| | Example No. | |
|---|---|---|
| | 4A Conventional Fuel | 4B Syngas Fuel |
| Fuel rates, kg/s | | |
| Firing Conditions | | |
| Hearth | | |
| Venturi Primary Throat | .1908 | .216 |
| Venturi Downstream | 0 | .538 |
| Secondary Staged Inner Row | .0629 | .0629 |
| Secondary Staged Outer Row | 0 | .411 |
| Tertiary | .0115 | .0559 |
| Hearth total: | .2652 | 1.284 |
| Wall | | |
| Primary Venturi | .324 | 0 |
| Downstream Venturi | 0 | 0.3 |
| Wall burner total | .324 | 0.3 |
| WS (total both rows) | .0702 (primary WS tips only) | 1.605 |
| Total fuel (hearth + wall + WS) | .6594 | 3.189 |
| Air rates, kg/s | | |
| Hearth | 5.72 | 3.79 |
| Wall | 7.05 | 5.95 |
| Total air | 12.77 | 9.74 |
| Air to Fuel Ratio | | |
| Total (w/all fuel) | 19.36 | 3.05 |
| Hearth (w/o Wall Stabilization Fuel) | 21.57 | 2.95 |
| Wall (including Wall Stabilization Fuel) | 17.88 | 3.12 |
| Process/Furnace Performance | | |
| Coil Outlet T, K | 1095 | 1091 |
| Bridgewall T, K | 1422 | 1446 |
| Flue Gas O2 mole % | .0186 (9.3% excess air) | .020 (10% excess air) |
| Max TMT, K | 1290 | 1265 |

Example 5

A CFD simulation was run using both convention fuel and synthesis gas. In this case, a resistance cap was added to the wall burners to direct the flow from these burners along the wall. Adding this wall resistance with synthesis gas flow volume lowered air flow rates. The results are shown below on Table 3 comparing the no resistance cases 4A and 4B with the resistance cases 5A and 5B.

TABLE 3

| | Example No. | | | |
|---|---|---|---|---|
| | 5A | 4A | 5B | 4B |
| | Conventional Fuel | | Syngas Fuel | |
| | Wall Resistance | No wall resistance | Wall resistance | No wall resistance |
| Feed rate, kg/s | 7.4 | 7.4 | 7.4 | 7.4 |
| Crossover T, K | 839 | 839 | 839 | 839 |
| Steam/Oil | .4 | .4 | .4 | .4 |
| | Fuel rates, kg/s | | | |
| Hearth | | | | |
| Primary venturi throat | .1908 | .1908 | .100 | .216 |
| Primary venturi downstream | 0 | 0 | .654 | .538 |
| Secondary Staged Inner row | .0629 | .0629 | .0629 | .0629 |
| Secondary Staged Outer row | 0 | 0 | .411 | .411 |
| Tertiary | .0115 | .0115 | .0559 | .0559 |
| Hearth total | .2652 | .2652 | 1.284 | 1.284 |
| Wall | | | | |
| Primary Venturi throat | .324 | .324 | 0 | 0 |
| Downstream Venturi | 0 | 0 | .3 | .3 |
| Wall total | .324 | .324 | 0.3 | 0.3 |
| WS | .0702 | .0702 | 1.605 | 1.605 |
| Total fuel | .6594 | .6594 | 3.189 | 3.189 |
| | Air rates, kg/s | | | |
| Hearth | 5.673 | 5.72 | 5.64 | 3.79 |
| Wall | 7.509 | 7.05 | 4.17 | 5.95 |
| Total air | 13.182 | 12.77 | 9.81 | 9.74 |
| Air to fuel Ratio | | | | |
| Total (w/ Wall Stabilization) | 19.99 | 19.36 | 3.08 | 3.05 |

TABLE 3-continued

| | Example No. | | | |
|---|---|---|---|---|
| | 5A | 4A | 5B | 4B |
| | Conventional Fuel | | Syngas Fuel | |
| | Wall Resistance | No wall resistance | Wall resistance | No wall resistance |
| Hearth (w/o Wall Stabilization) | 21.39 | 21.57 | 4.39 | 2.95 |
| Wall (including Wall Stabilization) | 19.05 | 17.88 | 2.19 | 3.12 |
| Coil Outlet T, K | 1090 | 1095 | 1087 | 1091 |
| Bridgewall T, K | 1395 | 1422 | 1406 | 1446 |
| Flue Gas O2 mole frac | .0246 (12.3% excess air) | .0186 (9.3% excess air) | .0243 (12% excess air) | .020 (10% excess air) |
| Max TMT, K | 1290 | 1290 | 1268 | 1265 |
| Primary Throat Port Inlet P, psig | 40.0 | 39.5 | 63.0 | 34.9 |
| C5 Conversion, % | 75.3 | 76.2 | 71.0 | 72.3 |

As is shown on Table 3, adding the cap to the wall burners to direct the flow along the walls decreased the wall burner air flow at equivalent primary venturi port flow by increasing the pressure drop across the system. To compensate for this, the pressure in the header increased only slightly for the high heating value fuel but substantially for the lower heating value fuel due to its much higher volume flow (from 34.9 psig to 63 psig). The loss of air from the wall burner due to the higher pressure drop across that venturi assembly required that more air be supplied by the hearth burner. As can be seen the primary fuel injection for the hearth burners increased from 0.216 to 0.432 kg/sec and the flow to the downstream port decreased from 0.538 to 0.322 kg/sec. This increased the hearth air flow from 3.79 to 5.115 kg/sec. The total air to the heater remained essentially constant for each fuel respectively.

Adding the resistance changed the control range of the venturi assembly but in all cases, stable operation and consistent process performance was achieved without the need to change air damper positions and/or ID fan speed. Note that adding cap to the wall burner is a design choice not a variable to be modified online.

Example 6

Figure 10:
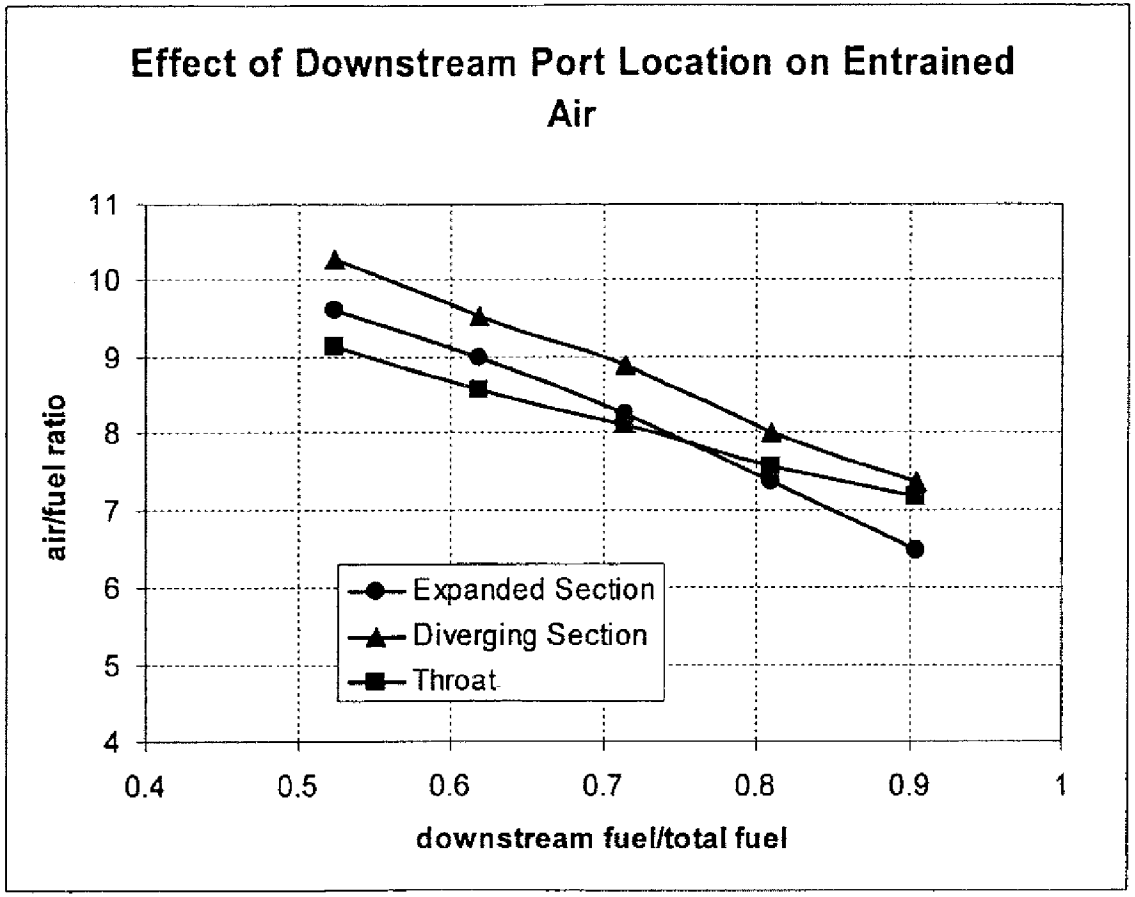
FIG. 10 shows the results of a computational fluid dynamics simulation showing the effect of downstream port location on entrained air.

A CFD simulation was run to show the effect of adding secondary fuel at various locations, including in the throat portion of the venturi, the diverging portion, and the straight portion downstream from the diverging portion as shown in the venturi assembly of FIG. 1. The results are shown on Table 4 and in FIG. 10.

TABLE 4

| Throat kg/s | Downstream kg/s | Expanded air, kg/s | Diverging air, kg/s | Throat air, kg/s | Air to fuel expanded | Air to fuel diverging | Air to fuel throat | Fraction dwnstrm fuel |
|---|---|---|---|---|---|---|---|---|
| 0.002 | 0.019 | 0.136 | 0.1548 | 0.1505 | 6.47619 | 7.371429 | 7.166667 | 0.904762 |
| 0.004 | 0.017 | 0.1545 | 0.1682 | 0.1586 | 7.357143 | 8.009524 | 7.552381 | 0.809524 |
| 0.006 | 0.015 | 0.1734 | 0.1871 | 0.1701 | 8.257143 | 8.909524 | 8.1 | 0.714286 |
| 0.008 | 0.013 | 0.1887 | 0.2004 | 0.1803 | 8.985714 | 9.542857 | 8.585714 | 0.619048 |
| 0.01 | 0.011 | 0.2019 | 0.2159 | 0.1918 | 9.614286 | 10.28095 | 9.133333 | 0.52381 |

As can be seen by the data in Table 4, the secondary gas injection point can be at any location downstream from the converging portion of the venturi. However, the control range and response will be different depending on the location and the inlet fuel rates of air, fuel and secondary gas.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A firing control system for controlling the air to fuel ratio in a burner assembly including at least one venturi assembly comprising:

an air inlet, a converging portion with a primary injection fuel inlet, a throat portion downstream from the converging portion, a diverging portion downstream from the throat portion, an outlet, and a secondary gas inlet disposed downstream from the converging portion and upstream from the outlet, the firing control system comprising:

a first flow control device configured to control fuel inlet flow at the primary injection fuel inlet, a second flow control device configured to control gas inlet flow to the secondary gas inlet, a first set of staged burner ports on at least one oldie hearth and the wall, and a fuel analysis component configured to determine whether the fuel at the fuel inlet has a lower heating value or a higher heating, value, wherein the flow rates through the first and second flow control devices are varied depending upon at least one of the composition of the fuel, the heating value of the fuel, the oxygen content at the heater outlet, and the desired air flow rate through the venturi assembly, wherein the second flow control device is also configured to control inlet flow to the first set of staged burner ports.

2. The firing control system of claim 1, wherein at least one of the first and second flow control devices is a valve.

3. The firing control system of claim 1, wherein at least one of the first and second flow control devices is a pressure regulator.

4. The firing control system of claim 1, further comprising a damper for assisting in control of the air inlet flow rate.

5. A firing control system for a furnace comprising:

a hearth, a side wall, and a burner assembly with at least one burner including a venturi assembly comprising:

an air inlet, a converging portion with a primary injection fuel inlet, a throat portion downstream from the converging portion, a diverging portion downstream from the throat portion, an outlet, and a secondary gas inlet disposed downstream from the converging portion and upstream from the outlet, the firing control system comprising:

a first flow control device configured to control fuel inlet flow to the primary injection fuel inlet, a second flow control device configured to control inlet flow to the secondary gas inlet, and a first set of staged burner ports on at least one of the hearth and the wall, wherein the flow rates through the first and second flow control devices are varied depending upon at least one of the composition of the fuel, the heating value of the fuel, the oxygen content at the heater outlet, and the desired air flow rate through the venturi assembly, wherein the second flow control device is also configured to control inlet flow to the first set of staged burner ports.

6. The firing control system of claim 5, further including a third flow control device configured to control inlet flow of a low heating value fuel to a second set of staged burner ports adjacent the first set of staged burner ports.

7. The firing control system of claim 5, further including a fuel analysis component configured to determine at least one of the composition and heating value of the fuel being fed to the primary injection fuel inlet.

8. The firing control system of claim 7, wherein the first and second flow control devices are controlled by the fuel analysis component.

9. A firing control system for a furnace comprising:

a hearth, a side wall, a furnace fuel inlet, and a burner comprising a venturi assembly with a first fuel inlet and a second fuel inlet, the firing control system comprising:

an oxygen analysis component configured to determine the post-combustion oxygen content of the furnace, and a first set of staged burner ports on at least one of the hearth and the wall, wherein the oxygen analysis component adjusts the relative fuel flow rates to the first and second fuel inlets of the venturi assembly and the first set of staged burner ports.

10. A firing control system for a furnace comprising:

a hearth, a side wall, and a burner with a furnace fuel inlet and a supplemental fuel inlet, the firing control system comprising:

a fuel analysis component configured to determine whether the fuel at the fuel inlet has a lower heating value or a higher heating value, and a first set of staged burner ports on at least one of the hearth and the wall, wherein the fuel analysis component controls the flow rate of fuel to at least one of the furnace fuel inlet, the supplemental fuel inlet, and the first set of staged burner ports.

* * * * *